US009716313B1

(12) United States Patent
Mumcu et al.

(10) Patent No.: US 9,716,313 B1
(45) Date of Patent: Jul. 25, 2017

(54) MICROFLUIDIC BEAM SCANNING FOCAL PLANE ARRAYS

(71) Applicants: Gokhan Mumcu, Tampa, FL (US); Rasim Oytun Guldiken, Tampa, FL (US); Ahmad Adel Gheethan, Tampa, FL (US)

(72) Inventors: Gokhan Mumcu, Tampa, FL (US); Rasim Oytun Guldiken, Tampa, FL (US); Ahmad Adel Gheethan, Tampa, FL (US)

(73) Assignee: University of South Florida, Tampa, FL (US)

( * ) Notice: Subject to any disclaimer, the term of this patent is extended or adjusted under 35 U.S.C. 154(b) by 243 days.

(21) Appl. No.: 14/324,681

(22) Filed: Jul. 7, 2014

Related U.S. Application Data

(60) Provisional application No. 61/843,363, filed on Jul. 6, 2013.

(51) Int. Cl.
*H01Q 3/04* (2006.01)
*H01Q 19/06* (2006.01)
*H01Q 3/08* (2006.01)

(52) U.S. Cl.
CPC ..... *H01Q 3/04* (2013.01); *H01Q 3/08* (2013.01); *H01Q 19/062* (2013.01)

(58) Field of Classification Search
CPC H01Q 3/005; H01Q 3/01; H01Q 3/02; H01Q 3/04; H01Q 3/08; H01Q 3/12; H01Q 3/24; H01Q 3/245; H01Q 21/06; H01Q 21/061; H01Q 21/065; H01Q 21/08; H01Q 21/20; H01Q 21/205; H01Q 21/225; H01Q 21/24; H01Q 21/245; H01Q 21/28; H01Q 21/29; H01Q 21/293
See application file for complete search history.

(56) References Cited

U.S. PATENT DOCUMENTS 4,684,952 A 8/1987 Munson et al.
8,125,393 B2 * 2/2012 Dreina ..... H01Q 3/01 343/700 MS
9,293,821 B2 * 3/2016 Duwel ..... H01Q 3/446

OTHER PUBLICATIONS

Scott Segal, STIC search report, STIC, May 13, 2016.*
A. Abbaspour-Tamijani and K. Sarabandi, "An affordable millimeter-wave beam-steerable antenna using interleaved planar subarrays," Antennas and Propagation, IEEE Transactions on, vol. 51, pp. 2193-2202, 2003.
A. Babakhani, D. B. Rutledge, and A. Hajimiri, "MM-wave phased arrays in silicon with integrated antennas," in Proc. IEEE Antennas Propag. Soc. Int. Symp., Jun. 9-15, 2007, pp. 4369-4372.
(Continued)

*Primary Examiner* — Tho G Phan
*Assistant Examiner* — Patrick Holecek
(74) *Attorney, Agent, or Firm* — Thomas | Horstemeyer, LLP

(57) ABSTRACT

In some embodiments, a microfluidic beam scanning focal plane array for a beam scanning antenna includes an elongated microfluidic channel that contains an electrically conductive antenna element suspended within a dielectric fluid that is provided within the channel and means for moving the position of the antenna element along a length of the channel to change a direction along which electromagnetic waves are transmitted or received.

18 Claims, 10 Drawing Sheets

(56) References Cited

OTHER PUBLICATIONS

K. Bahadori and Y. Rahmat-Samii, "An Array-compensated Spherical Reflector Antenna for a Very Large Number of Scanned Beams," IEEE Transactions on Antennas and Propagation, vol. 53, No. 11, pp. 3547-3555, 2005.
D. Berry, R. Malech, and W. Kennedy, "The reflectarray antenna," Antennas and Propagation, IEEE Transactions on, vol. 11, pp. 645-651,1963.
S. Cheng, A. Rydberg, K. Hjort, and Z. Wu, "Liquid Metal Stretchable Unbalanced Loop Antenna," Applied Physics Letters, vol. 94, pp. 144103 1-144103 3, 2009.
S. Cheng, Z. Wu, K. Hjort, and A. Rydberg, "Foldable and Stretchable Liquid Metal Planar Inverted Cone Antenna," IEEE Transactions on Antennas and Propagation, vo. 57, No. 12, pp. 3765-3770, Dec. 2009.
J.-C. S. Chieh, P. Anh-Vu; T. W. Dalrymple, D. G. Kuhl, B. B. Garber, and K. Aihara, "A Light Weight 8-element Broadband Phased Array Receiver on Liquid Crystal Polymer," IEEE International Microwave Symposium Digest (MTT), pp. 1024-1027, 2010.
K. Choul-Young, K. Dong-Woo, and G. M. Rebeiz, "A 44-46-GHz 16-Element SiGe BiCMOS High-Linearity Transmit/Receive Phased Array," Microwave Theory and Techniques, IEEE Transactions on, vol. 60, pp. 730-742, 2012.
Y. Damgaci and B. A. Cetiner, "A frequency reconfigurable antenna based on digital microfluidics," Lab Chip, Jul. 2013, 10.1039/C3LC50275A.
G. J. Hayes, S. Ju-Hee, A. Qusba, M. D. Dickey, and G. Lazzi, "Flexible Liquid Metal Alloy (EGaIn) Microstrip Patch Antenna," Antennas and Propagation, IEEE Transactions on, vol. 60, pp. 2151-2156, 2012.
K. Jing-Lin, L. Yi-Fong, H. Ting-Yi, C. Yi-Long, H. Yi-Keng, P. Pen-Jui, et al., "60-GHz Four-Element Phased-Array Transmit/Receive System-in-Package Using Phase Compensation Techniques in 65-nm Flip-Chip CMOS Process," Microwave Theory and Techniques, IEEE Transactions on, vol. 60, pp. 743-756, 2012.
D-W Kang, J-G. Kim, B-W Min, and G. M. Rebeiz, "Single and Four-Element Ka-Band Transmit/Receive Phased-Array Silicin RFICs With 5-bit Amplitude and Phase Control," IEEE Transactions on Microwave Theory and Techniques, vol. 56, No. 5, part. 1, pp. 1013-1023, 2008.
M. G. Keller, J. Shaker, A. Petosa, A. Ittipiboon, M. Cuhaci, and Y. M. M. Antar, "A Ka-Band Dielectric Resonator Antenna Reflectarray," in Microwave Conference, 2000. 30th European, 2000, pp. 1-4.
M. R. Khan, G. J. Hayes, J-H So, G. Lazzi, and M. D. Dickey, "A Frequency Shifting Liquid Metal Antenna with Pressure Responsiveness," Applied Physics Letters, vol. 99, pp. 013501 1-013501 3, 2011.
K. Kwang-Jin, J. W. May, and G. M. Rebeiz, "A Millimeter-Wave (40-45 GHz) 16-Element Phased-Array Transmitter in 0.18-um SiGe BiCMOS Technology," Solid-State Circuits, IEEE Journal of, vol. 44,pp. 1498-1509, 2009.
T. Lambard, O. Lafond, M. Himdi, H. Jeuland, S. Bolioli, and L. Le Coq, "Ka-band phased array antenna for high-datarate SATCOM," Antennas and Wireless Propagation Letters, IEEE, vol. 11, pp. 256-259, 2012.
B. J. Lei, A. Zamora, T. F. Chun, A. T. Ohta, and W. A. Shiroma, "A Wideband, Pressure-Driven, Liquid-Tunable Frequency Selective Surface," IEEE Microwave and Wireless Components Letters, vol. 21, No. 9, pp. 465-467, Sep. 2011.
M. Li, B. Yu, and N. Behdad, "Liquid-Tunable Frequency Selective Surfaces," IEEE Microwave and Wireless Components Letters, vol. 20, No. 8, pp. 423-425, Aug. 2010.
S. J. Mazlouman, X. J. Jiang, A. Mahanfar, C. Menon, and R. G. Vaughan, "A Reconfigurable Patch Antenna Using liquid metal Embedded in a Silicone Substrate," vol. 59, No. 12, pp. 4406-4412, Dec. 2011.
A. Natarajan, S. K. Reynolds, T. Ming-Da, S. T. Nicolson, J. H. C. Zhan, K. Dong Gun, et al., "A Fully-Integrated 16-Element Phased-Array Receiver in SiGe BiCMOS for 60-GHz Communications," Solid-State Circuits, IEEE Journal of, vol. 46, pp. 1059-1075, 2011.
C. Neumann, S. Schutz, F. Wolschendorf, Y. Venot, "Ka-Band Seeker With Adaptive Beam Forming using MEMS Phase Shifters," European Radar Conference—EuRAD, pp. 100-103, 2008.
N. Ngoc Tinh, R. Sauleau, M. Ettorre, and L. Le Coq, "Focal Array Fed Dielectric Lenses: An Attractive Solution for Beam Reconfiguration at Millimeter Waves," Antennas and Propagation, IEEE Transactions on, vol. 59, pp. 2152-2159, 2011.
D. M. Pozar, S. D. Targonski, and H. D. Syrigos, "Design of millimeter wave microstrip reflectarrays," Antennas and Propagation, IEEE Transactions on, vol. 45, pp. 287-296, 1997.
K. Sudhakar Rao, G. A. Morin, M. Q. Tang, S. Richard, and C. Kwok Kee, "Development of a 45 GHz multiple-beam antenna for military satellite communications," Antennas and Propagation, IEEE Transactions on, vol. 43, pp. 1036-1047, 1995.
Gheethan, et al. "Microfluidic Based K-Band Beam-Scanning Focal Plane Array", IEEE Antennas and Wireless Propagation Letters, vol. 12, 2013.
Gheethan, et al. "Microfluidic Enabled Beam Scanning Focal Plane Arrays", IEEE Antennas and Propagation Society International Symposium, pp. 208, 209, Jul. 7-13, 2013.
Long, et al. "A Fluidic Loading Mechanism for Phase Reconfigurable Reflectaray Elements," IEEE Antennas and Wireless Propagation Letters, vol. 10, pp. 876-879, 2011.

* cited by examiner

MICROFLUIDIC BEAM SCANNING FOCAL PLANE ARRAYS

CROSS-REFERENCE TO RELATED APPLICATION(S)

This application claims priority to U.S. Provisional Application Ser. No. 61/843,363, filed Jul. 6, 2013, which is hereby incorporated by reference herein in its entirety.

BACKGROUND

The increasing sampling capabilities of emerging surveillance, communication, and imaging systems (such as the wide area airborne-motion imaginary units, future satellite technologies, and millimeter-wave (mm-wave) imaging systems) necessitate high-gain antennas with wide-field-of-view (WFoV) beam steering capabilities. The antenna components of these systems are traditionally implemented with reflectors, lenses, and phased arrays.

Reflector antennas are typically not attractive as they are bulky and require a very precise mechanical elevation/azimuth scan over a WFoV at mm-waves. Microwave lenses, on the other hand, can be lightweight and compact. However, conventional designs generally suffer from low-scan volumes. More importantly, high-gain WFoV beam scanning typically requires a complicated radio frequency (RF) switch matrix and power divider implementations to accommodate tightly packed receive/transmit arrays at the focal plane. Phased antenna arrays offer important advantages over reflectors and lenses because they can potentially provide low-profile and high-efficiency apertures due to the absence of spill-over losses. However, for high-gain mm-wave apertures, their advantages are accompanied by high system complexity and cost. For example, a 30 GHz Ka-band ideal-phased array with 100% aperture efficiency can require an aperture size of 9×9 $cm^2$ to deliver 30 dB directivity. If realized from half-wavelength spaced antenna elements, the phased array may require 18×18 (i.e., 324) antennas and a substantial amount of hardware in the form of phase shifters and power dividers.

From the above discussion, it can be appreciated that it would be desirable to have practical and low-cost implementations of beam scanning antennas that meet the demanding needs of high gain and WFoV. Such implementations hold promise to transform the use of high data rate surveillance, communication, and imaging systems from specialized needs into mainstream technologies.

BRIEF DESCRIPTION OF THE DRAWINGS

The present disclosure may be better understood with reference to the following figures. Matching reference numerals designate corresponding parts throughout the figures, which are not necessarily drawn to scale.

FIG. 3A shows the $|S_{11}|$ performance of antenna patches #1-#4 and FIG. 3B shows the normalized radiation pattern ($\phi$=0°) when an antenna lens is excited by patches #1-#4.

FIG. 3A shows the $|S_{11}|$ performance and FIG. 3B shows the normalized gain pattern.

DETAILED DESCRIPTION

As described above, it would be desirable to have practical and low-cost implementations of beam scanning antennas. Disclosed herein are microfluidic beam scanning focal plane arrays (FPAs) that can be used to form such antennas. The arrays comprise one or more microfluidic channels along which an antenna element can be positioned at different locations to scan a beam across a wide-field-of-view (WFoW). In some embodiments, the antenna element comprises a small volume of an electrically conductive liquid or a solid electrically conductive element that is suspended in a dielectric liquid. The position of the antenna element can be adjusted by urging the dielectric liquid through the channel(s) to cause the antenna element to move through the channel(s). In some embodiments, one or more microfluidic pumps are used to achieve this movement.

In the following disclosure, various specific embodiments are described. It is to be understood that those embodiments are example implementations of the disclosed inventions and that alternative embodiments are possible. All such embodiments are intended to fall within the scope of this disclosure.

Figure 1A:
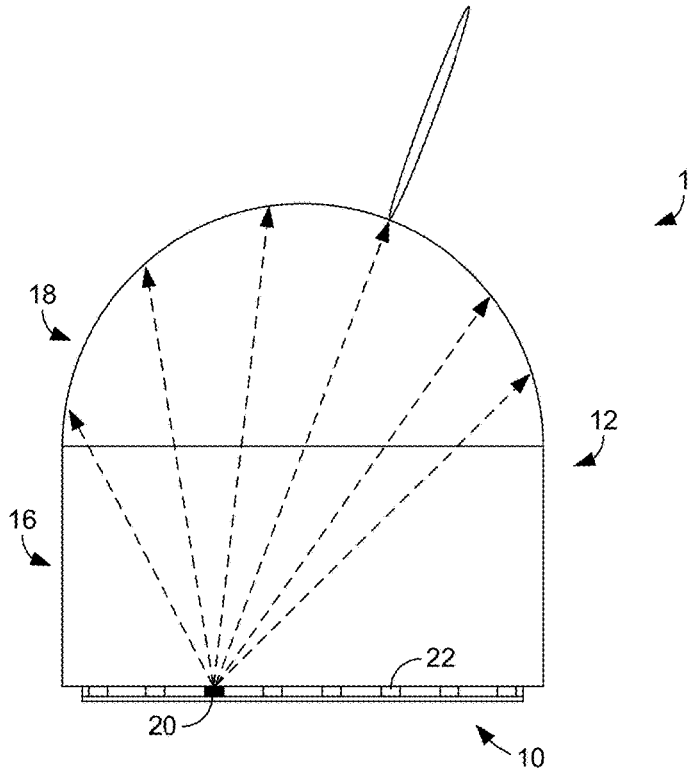
FIG. 1A is a side view of an embodiment of a beam scanning antenna that includes a microfluidic focal plane array.

FIG. 1A schematically illustrates an example embodiment of beam scanning antenna 1 that includes a microfluidic focal plane array 10 and a hemispherical lens 12 that is positioned on top of the array. The lens 12 is made of an appropriate transparent or translucent material, such as optical glass or a polymer, and generally comprises a cylindrical base 16 and a hemispherical top 18. Although a hemispherical lens is shown in FIG. 1A, it is noted that other types of lenses could be used, such as Fresnel lenses and frequency selective surface-based synthesized lenses.

Figure 1B:
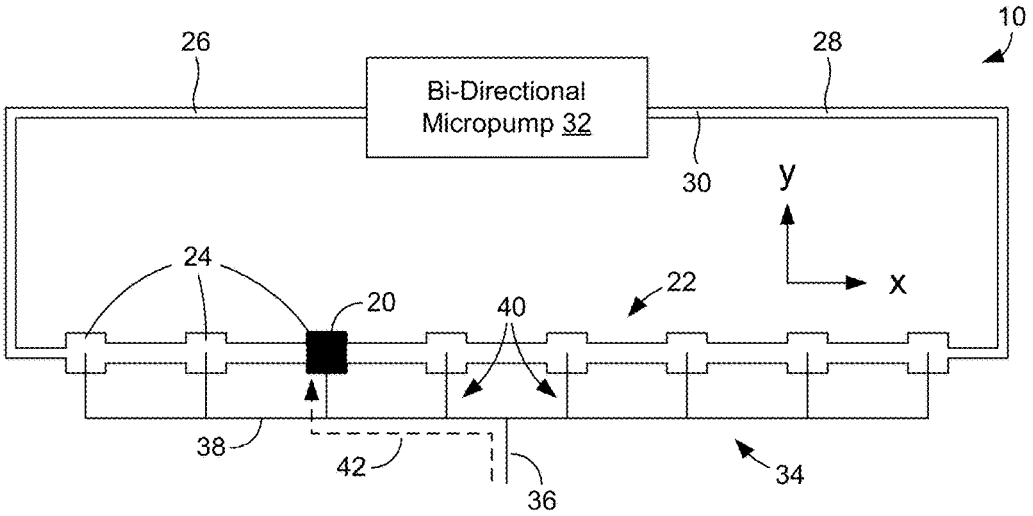
FIG. 1B is a schematic view of an embodiment of a microfluidic focal plane array that can be used to construct the beam scanning antenna of FIG. 1A.

As is further shown in FIG. 1A, the microfluidic focal plane array 10 has been manipulated to position an antenna element 20 in one of eight different possible positions along a microfluidic channel 22 that forms the array. FIG. 1B shows an example configuration for the array 10. As is apparent in FIG. 1B, the array 10 is formed as a one-dimensional array. It is noted, however, that, in other embodiments, the array can be two dimensional (see, e.g., FIG. 8B). The microfluidic channel 22 comprises a narrow, elongated continuous channel along which the antenna element 20 can be driven. Spaced along the length of the channel 22 are multiple microfluidic chambers 24 (eight in this example) that are adapted to alternatively receive the antenna element 20. In the illustrated embodiment, it is assumed that the antenna element 20 is an electrically conductive liquid, such as mercury ($\sigma$=1×106 S/m), that has a volume sufficient to more or less fill the chamber 24 to which it is driven. In other embodiments, however, the antenna element 20 can comprise a solid conductive element, such as a small metal plate or metalized plate.

As is further shown in FIG. 1B, the microfluidic channel 22 is in fluid communication with microfluidic drive channels 26 and 28 that supply a dielectric fluid 30, such as polytetrafluoroethylene (PTFE) fluid (e.g., AF1601S Teflon®), that is contained within the supply channels as well as the microfluidic channel 22. The dielectric fluid 30 can be driven through the drive channels 26, 28 using a bi-directional micropump 32 that is also in fluid communication with the drive channels to drive the antenna element 20 to a desired chamber 24. For example, if the dielectric fluid 30 is driven by the micropump 32 through the drive channel 28 (to the right in FIG. 1B), the dielectric fluid can drive the antenna element 20 toward the other drive channel 26 (to the left in FIG. 1A). By so driving the antenna element 20, the antenna element can be, for instance, moved from the third position (as shown in FIG. 1B) to the second position from the left.

With further reference to FIG. 1B, the focal plane array 10 further comprises a proximity-coupled microstrip line feed network 34 that includes an input line 36, a feed line 38, and multiple feed stubs 40 that extend from the feed line, one stub extending to each of the chambers 24 of the microfluidic channel 20. The length of the feed stubs can be designed to be $\lambda_g/2$ ($\lambda_g$=6.62 mm at 30 GHz) to present an open circuit (OC) condition to the feed line 38 when the chambers 24 do not comprise the antenna element 20. In addition, the separation between the stubs 40 (as well as the chambers 24) can be designed to be $\lambda_g$ to provide the necessary OC conditions in order to direct the RF power to the antenna element 20 without needing any active RF switches. The feed network 34 is adapted to deliver radio frequency (RF) signals to or from the antenna element 20 when it resides in one of the chambers 24. As an example, an RF signal can trace the path identified by line 42 in FIG. 1B from the input line 36 to the stub 40 associated with the antenna element 20, which acts as a patch antenna. The antenna element 20 can then transmit the signal using the hemispherical lens 12, as illustrated in FIG. 1A.

Figure 2A:
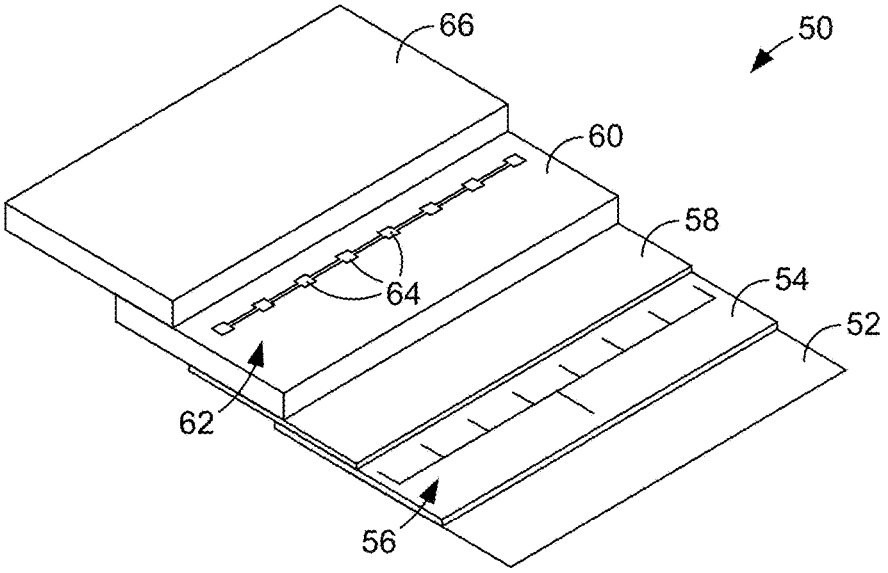
FIG. 2A is a perspective view of an embodiment of a microfluidic focal plane array constructed from a stack comprising multiple layer of material.

The microfluidic focal plane array 10 can be formed in a variety of different ways. In some embodiments, the various channels of the array can be formed from microfluidic tubing. In other embodiments, the entire microfluidic focal plane array 10 can be fabricated from multiple layers of material using semiconductor fabrication techniques. FIG. 2A illustrates an embodiment of such a microfluidic focal plane array 50 in an exploded view. In the illustrated embodiment, the array 50 comprises a stack of layers that includes a ground plane 52, a first layer 54 that overlies the ground plane on which a feed network 56 is formed, a second layer 58 that overlies the first layer, a third layer 60 that overlies the second layer in which a microfluidic channel 62 having multiple chambers 64 is formed, and a fourth layer 66 that overlies the third layer. In some embodiments, the ground plane 52 is made of a metal material such as copper, the first layer 54 is made of a dielectric material such as a fiber-reinforced polymeric material, the second layer 58 is made of another dielectric material such as a liquid crystal polymer (LCP) material, the third layer 60 is made of a further dielectric material such as a silicone material, and the fourth layer 66 is the hemispherical lens, which can be made of cross-linked polystyrene microwave polymer.

Figure 2B:
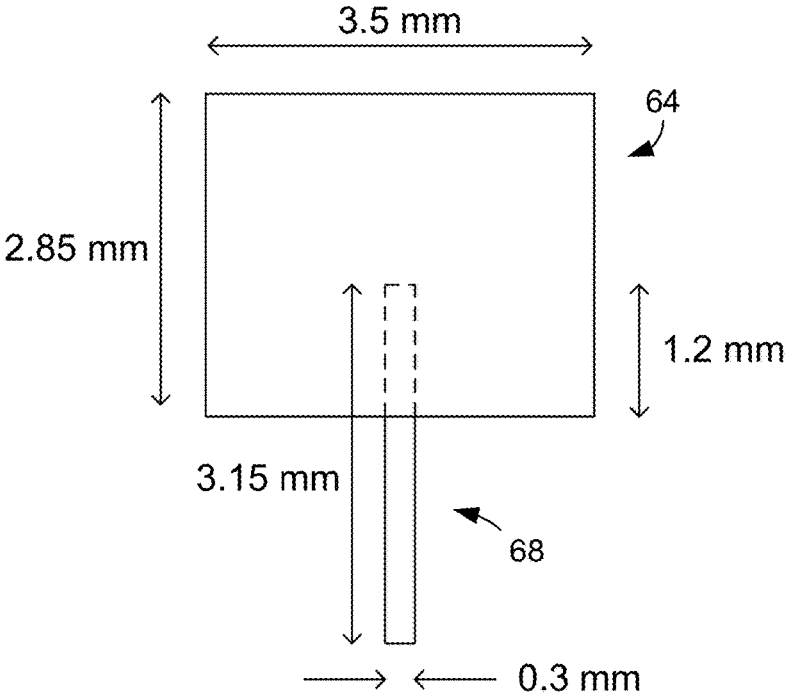
FIG. 2B is a schematic view of an embodiment of a chamber and a feed stub of the microfluidic focal plane array of FIG. 2A.

A microfluidic focal plane array was designed for evaluation and simulation purposes. The design had a construction similar to that shown in FIG. 2A. In the design, the first layer 54 was a 127 μm thick RT5880 layer, the second layer 58 was a 50 μm LCP layer, the third layer 60 was a 2 mm thick polydimethylsiloxane (PDMS) layer, and the fourth layer 66 (lens) was made of Rexolite™. FIG. 2B shows the dimensions for one of the chambers 64 and one of the feed stubs 68 of the feed network 56 in the design. The microfluidic channel 20 and chambers 24 were 250 μm deep. The antenna element was assumed to be a small volume of liquid metal. In the simulation, a semi-infinite half-space was assumed over the PDMS layer to model the presence of the electrically large hemispherical lens.

Figure 3A:
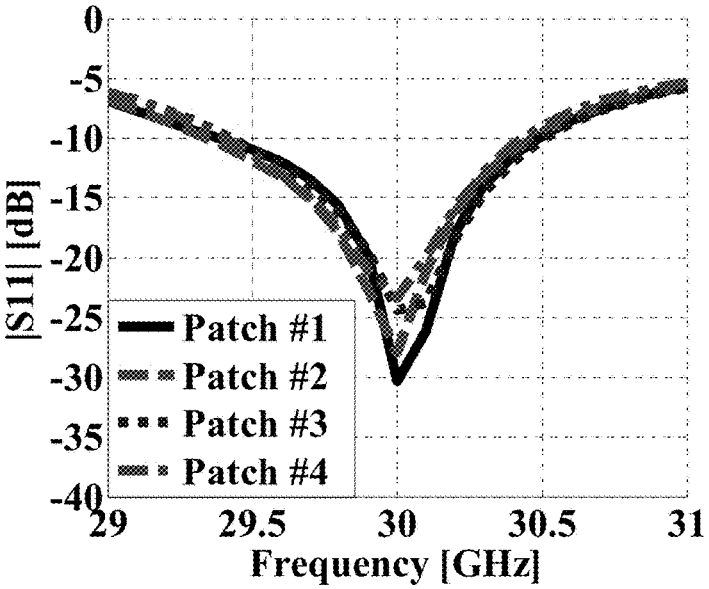
FIGS. 3A and 3B are graphs that show the simulated performance of a proposed microfluidic focal plane array design. More particularly.
Figure 3B:
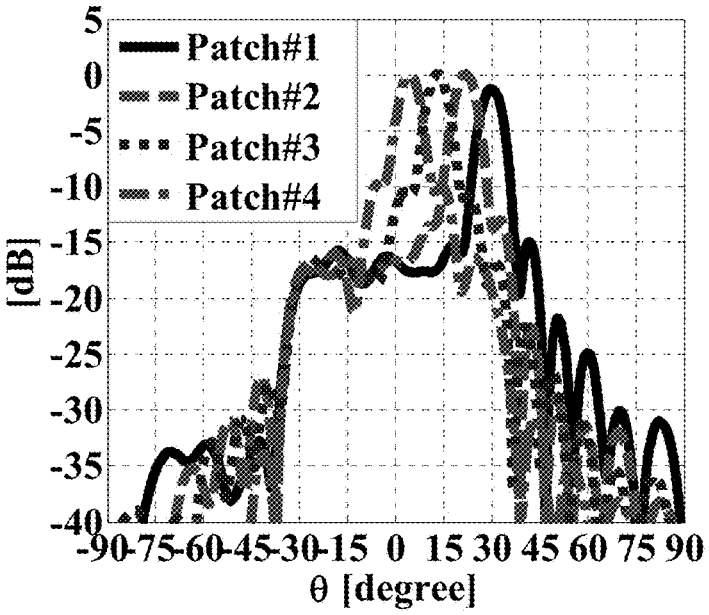
Figure 4A:
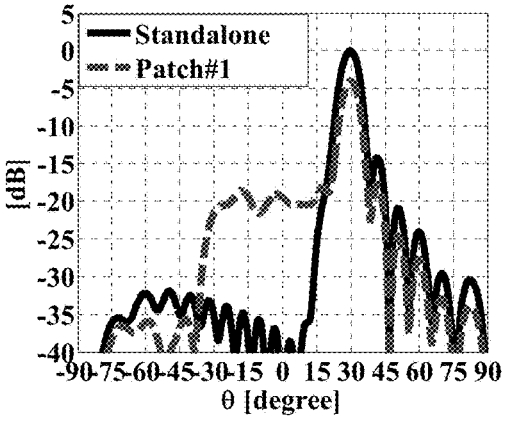
FIGS. 4A-4D are graphs that provide patch and array pattern comparisons when the antenna patch is located at the position of A: patch #1, B: patch #2, C: patch #3, and D: patch #4.
Figure 4B:
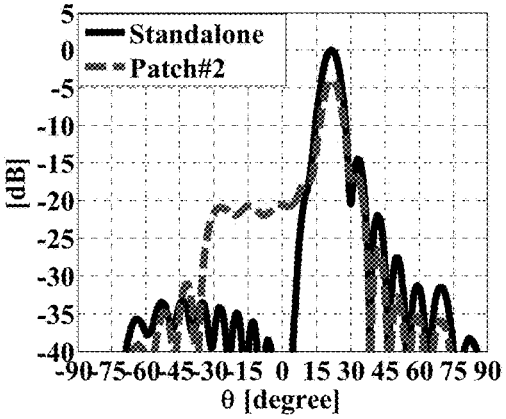
Figure 4C:
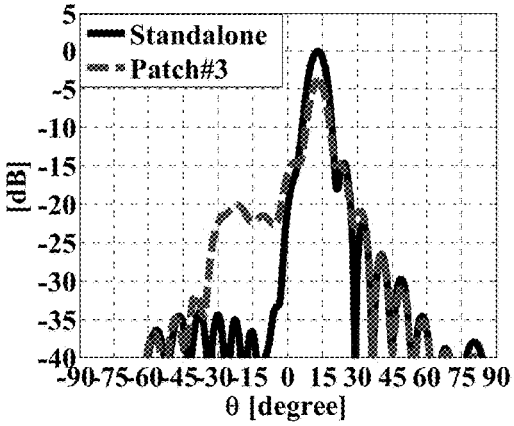
Figure 4D:
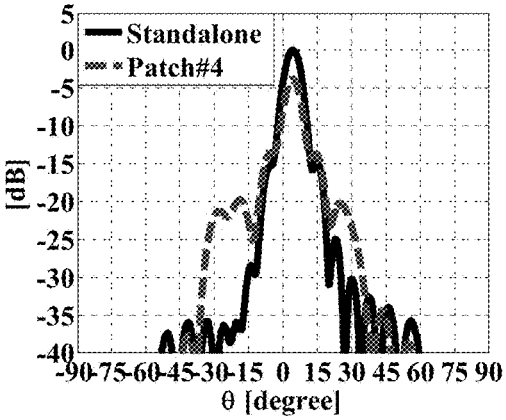

The simulated $|S_{11}|$ performance as the liquid metal moved from the first (i.e., the leftmost) chamber to the fourth chamber over the passive proximity coupled feed network is depicted in FIG. 3B (due to the array symmetry, only the performances of patches #1 to #4 are presented). As can be seen in this figure, a resonant frequency of 30 GHz and similar $|S_{11}|$ performance is achieved when any of the chambers are filled with liquid metal. This implies the successful operation of the designed passive feed network in routing the RF power to the liquid metal patch element. An in-house ray tracing MATLAB® code that utilizes the ADS® simulated patterns was employed for computing the far field patterns generated by the extended hemispherical lens. As demonstrated in FIG. 3B, moving the liquid metal among the chambers provides different excitation locations at the back surface of the extended hemispherical lens that, in turn, provides beam scanning capability. The focal plane array exhibits a half power beamwidth of 7° in the $\phi$=0° elevation plane, implying 29 dB of directivity according to Krauss' approximation. A ±30° FoV is accomplished over the $\phi$=0° elevation plane with individual element patterns overlapping at their half power beamwidths.

It is important to note that the resonant nature of the utilized passive feed mechanism may result in performance degradation due to radiation leakage as realization of perfect open circuit stub terminations is not practically possible. In addition, a long microstrip input line was used to feed the antenna from the side of the lens (see FIG. 6B), which increases the network loss. Therefore, to quantify the loss associated with the feed network, computational studies were performed by comparing radiation pattern performance of the microfluidic based focal plane array to that of a stand-alone patch antenna excitation (i.e., without any feed line). FIGS. 4A-4D present these radiation pattern comparisons for all focal plane array elements. It is observed that the feed line loss accounts for 4.06 dB, 3.88 dB, 3.90 dB, and 3.82 dB reductions in realized gain for the patch antenna locations #1, #2, #3, and #4, respectively. The average feed network loss is therefore 3.92 dB. This is comparable to the performance of a conventional eight-element focal plane array implementation that would utilize a total of seven SP2T switches and activate a patch element through the series connection of three SP2T switches. Commercially-available, state-of-the-art Ka-band SP2T switches exhibit approximately 1 dB insertion loss and the conventional feed network will potentially exhibit greater than 3 dB insertion loss due to the additional interconnects, microstrip line sections, and bends. The radiation patterns presented in FIG. 4 also reveal an enlargement in the sidelobe level for the microfluidic based beam scanning array within the ±30° scan range due to the feed network radiation. Specifically, the sidelobe level due to feed network radiation is relatively constant in the scan range and 20 dB below the main beam.

Figure 5A:
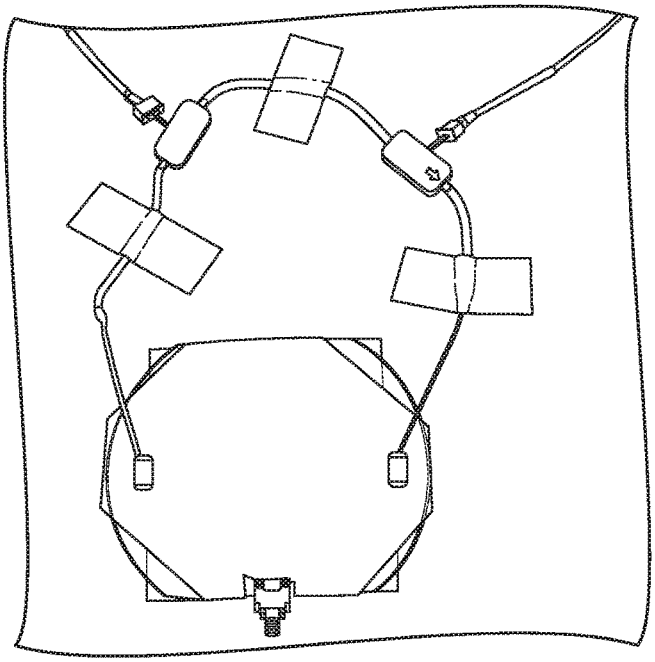
FIG. 5A is a photograph of a switching speed test setup.
Figure 5B:
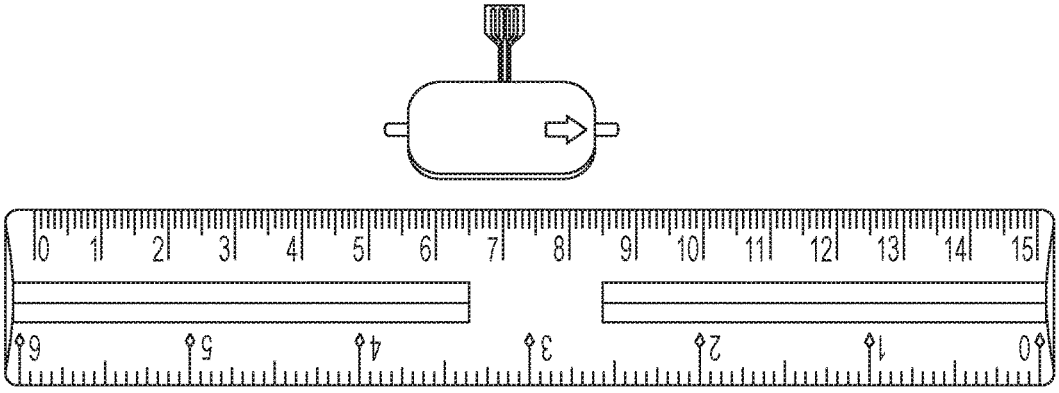
FIG. 5B is a photograph of a mp6 piezoelectric micropump.

In addition to the radiation performance, the array beam scanning time was characterized using an mp6 piezoelectric micropump and mp-x controlling unit acquired from micro-Components® as shown in FIG. 5A. The micropumps are compact in size (30×1.5×3.8 $mm^3$) and two of them can be cascaded in series to form a bi-directional pumping unit. These pumps were able to move the liquid metal patch to the adjacent chamber in 70 msec. The switching time can be potentially reduced down to a few msec using mechanically faster pumps.

A prototype of the microfluidic channel was fabricated using a PDMS micromolding technique. To obtain the mold layer, negative photoresist (SU-8 2075) was spun onto a silicon wafer and then patterned with a UV light source. The PDMS oligomer and crosslinking prepolymer of the PDMS agent from a Sylgard™ 184 kit (Dow Corning) was mixed in a weight ratio of 10:1, poured onto the SU-8 mold, and then cured at room temperature for 24 hours to prevent PDMS shrinking due to heat.

Bonding the channels to a 50 μm LCP was accomplished by using APTES (3-aminopropyltriethoxysilane) functionalized SU-8 as an intermediate layer between the PDMS and LCP layers. SU-8 was spun on 50 μm thick LCP substrate and soft baked subsequently. The baked photoresist was then exposed to ultraviolet (UV) light and post baked again. After developing, the SU-8 was hard baked. The surface of the SU-8 coated LCP substrate was then activated by oxygen plasma treatment. Later, the substrate was placed in a 1% v/v APTES solution-heated to 800° C. for 20 minutes. Subsequently, the functionalized SU-8 and the fabricated PDMS micro channel mold were exposed to oxygen plasma. The two surfaces were placed in conformal contact for 1 hour. After this process, the two surfaces were irreversibly bonded to each other due to the formation of a strong Si—O—Si covalent bond.

Figure 6A:
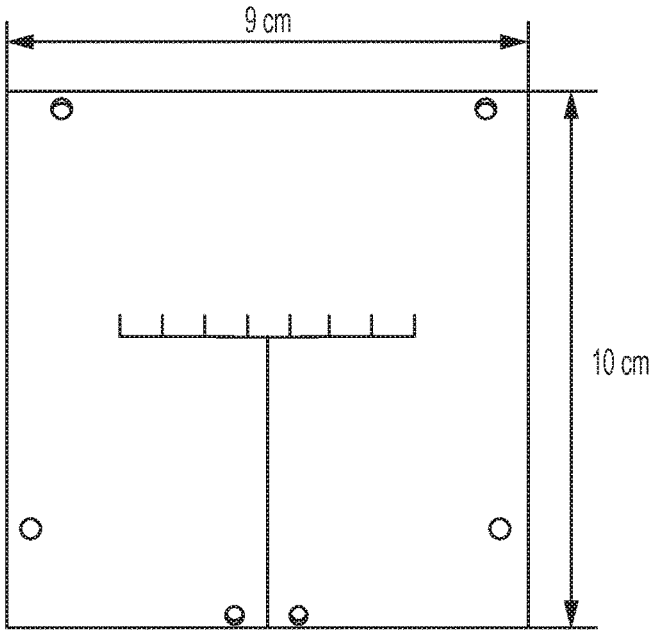
FIG. 6A is a photograph of a fabricated feed network.
Figure 6B:
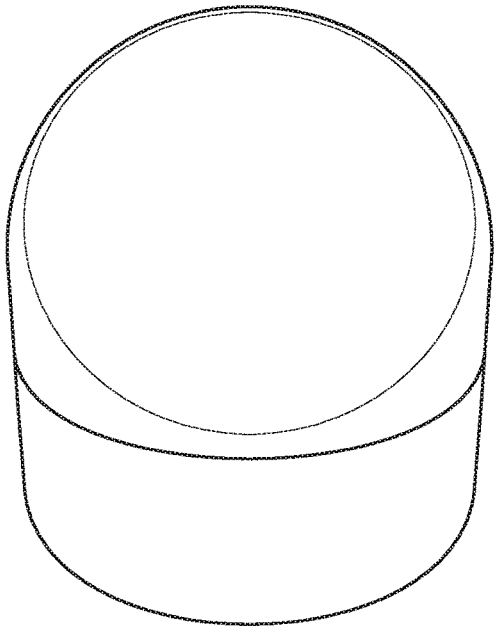
FIG. 6B is a photograph of a dielectric extended hemispherical lens.
Figure 6C:
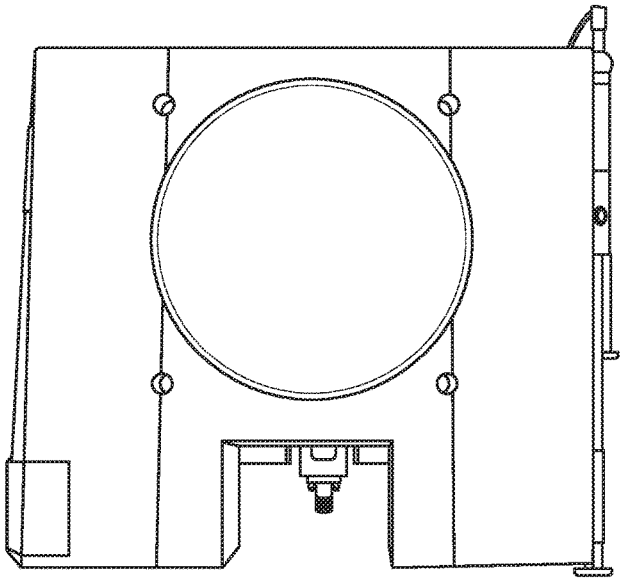
FIG. 6C is a photograph of a top view of a prototype beam scanning antenna.
Figure 6D:
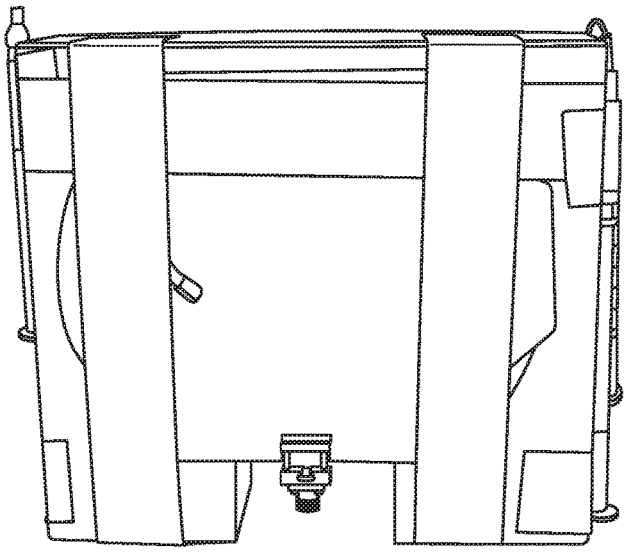
FIG. 6D is a photograph of a bottom view of the prototype beam scanning antenna.

FIGS. 6A and 6B depict the lithographically-fabricated array feed network and machined dielectric lens. In order to obtain a robust structure, the lens was placed in custom built polystyrene foam holder as shown in FIG. 6C. The feed network and channels were then flushed to their bottom surfaces using tape, as depicted in FIG. 6D.

Figure 7A:
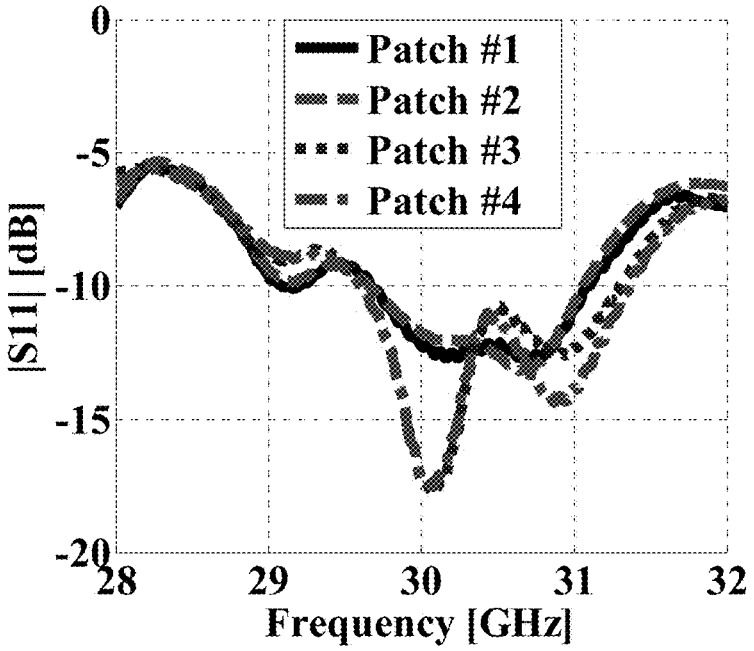
FIGS. 7A and 7B are graphs that show the measured performance of the prototype beam scanning antenna. More particularly.
Figure 7B:
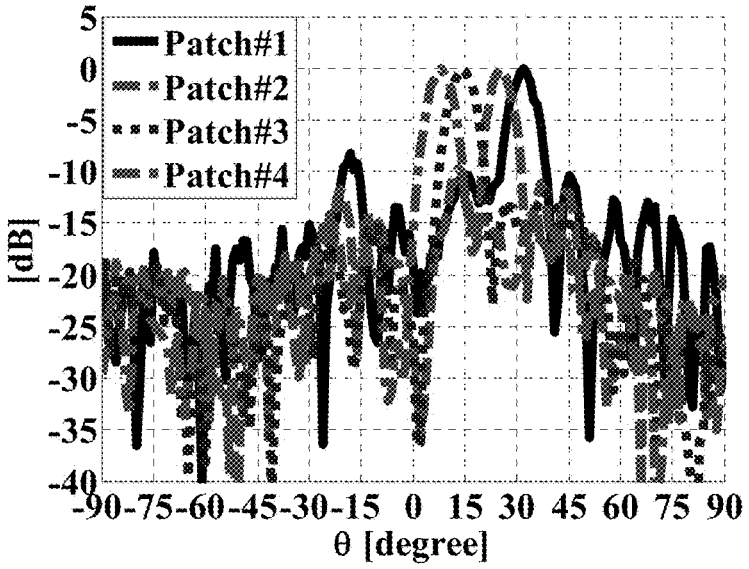

For measurement ease within the anechoic chamber, syringes were used to move the liquid metal antenna. The array $|S_{11}|$ shown in FIG. 7A was measured by an Agilent N5227A PNA. The array exhibited a matched impedance response at 30 GHz when chambers #1 to #4 were individually hosting the liquid metal antenna element. The beam scanning capability of the array was verified by measuring its realized gain patterns in the $\phi=0°$ elevation plane. As shown in FIG. 7B, the array scanned the beam as the liquid metal antenna was moved among the chambers. Table I summarizes the expected and measured scan angles, measured maximum gain, and the array efficiency calculated relative to the 29 dB directivity. As it can be inferred from the table, the measured and expected scan angles are in a very good agreement. The small discrepancy is due to the possible misalignment while installing the array at the lens backside. A maximum realized gain of 24.8 dB was measured for patch #2, whereas the lowest gain was 21.5 dB when patch #4 was activated. On average, the array exhibited 5.7 dB loss. The measured loss values were comparable to the simulated 3.9 dB feed network loss described above. The additional 1.8 dB loss was identified to be due to the connector loss and lens-air interface reflection. Nevertheless, the obtained performance is promising as compared to a conventional switch based focal plane array implementation and holds potential for implementing mm-wave low-cost high gain beam scanning arrays.

TABLE I

Array Summarized Measured and Simulated Performance

| | Patch#1 | Patch#2 | Patch#3 | Patch#4 |
|---|---|---|---|---|
| Scan Angle (measured, calculated) | (32°, 30°) | (25°, 22°) | (14°, 13°) | (7°, 4°) |
| Measured Gain [dB] | 21.5 | 23.2 | 24.8 | 23.9 |
| Calculated Efficiency | 17.8% | 26.3% | 38% | 30.9% |

Figure 8A:
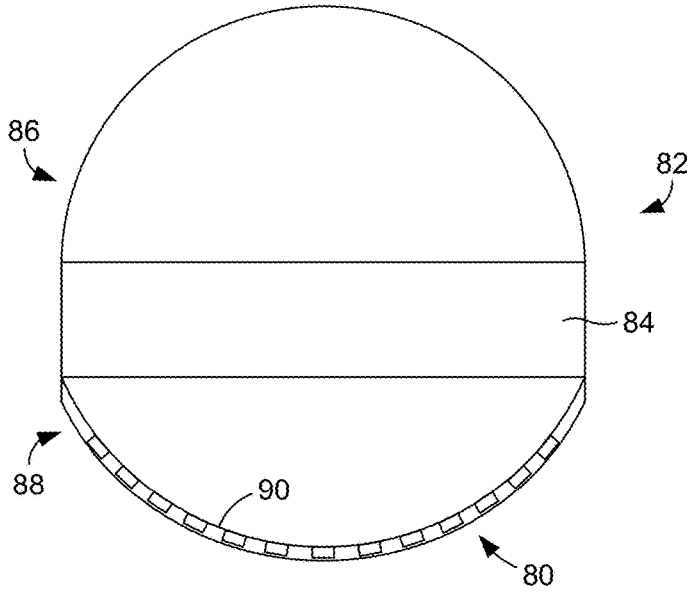
FIG. 8A is a side view of a further embodiment of a beam scanning antenna that includes a microfluidic focal plane array.

The focal plane array described above comprises but one example focal plane array design that can be used. FIG. 8 illustrates another embodiment. FIG. 8A illustrates a beam scanning antenna that comprises a microfluidic focal plane array 80 that is applied to hemispherical lens 82. Unlike the hemispherical lens 12 of FIG. 1A, however, the hemispherical lens 82 does not have a flat bottom (focal) surface. Instead, the lens 82 includes a cylindrical central portion 82, a top hemispherical portion 82, and a bottom hemispherical portion 88 that forms a spherically-curved bottom surface 90. The microfluidic focal plane array 80 is flexible so that it can curve to conform to this bottom surface 90.

Figure 8B:
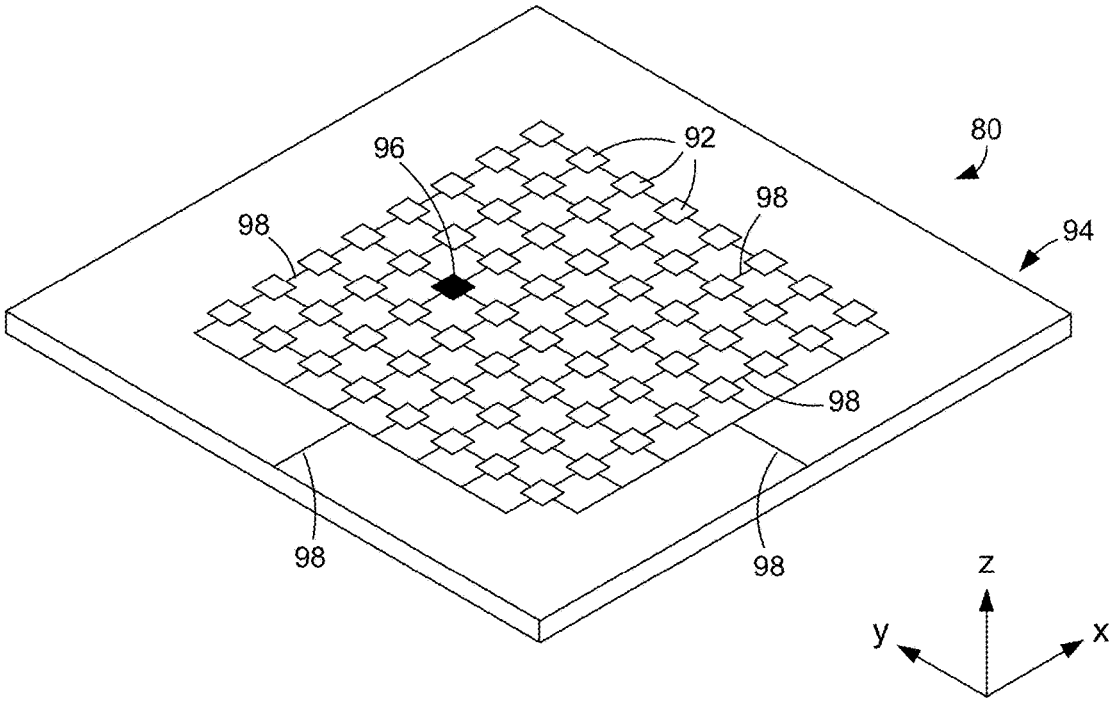
FIG. 8B is a schematic perspective view of an embodiment of a microfluidic focal plane array that can be used to construct the beam scanning antenna of FIG. 8A.

FIG. 8B illustrates an example embodiment for the microfluidic focal plane array 80. As shown in this figure, the array 80 comprises a two-dimensional array of multiple microfluidic chambers 92 that are formed in a stack 94 of flexible material layers. An antenna element 96, such as a small volume of conductive liquid or a metal or metallized microbead can be positioned within the chambers 92 to form a patch antenna by driving a dielectric fluid through microfluidic channels 98 that connect the chambers. The microfluidic channels 98 are arranged in rows and columns along the x and y directions and are in fluid communication with each other because they are in fluid communication with the chambers 92 to which they are connected. In such an embodiment, x and y direction movement of the antenna element 96 can be achieved using two bidirectional pumps (not shown), one for x direction movement and one for y direction movement. Not visible in FIG. 8B is the feed network used to address the chambers 92.

As mentioned above, the antenna element need not be a conductive liquid. In alternative embodiments, the antenna element can comprise a metallized element that is suspended within the dielectric liquid inside a microfluidic channel. By way of example, the metallized element can comprise a glass plate that has been sputter-coated with a highly-conductive metal, such as copper. Greater performance may be achieved in such embodiments if the metal of the element has higher electrical conductivity than available liquid metals. Moreover, if hard substrates such as quartz or alumina substrates are used to fabricate the microfluidic channels, greater power handling than that achievable with the PDMS-LCP embodiments and prior art MEMS-switched embodiments may be possible.

Figure 9:
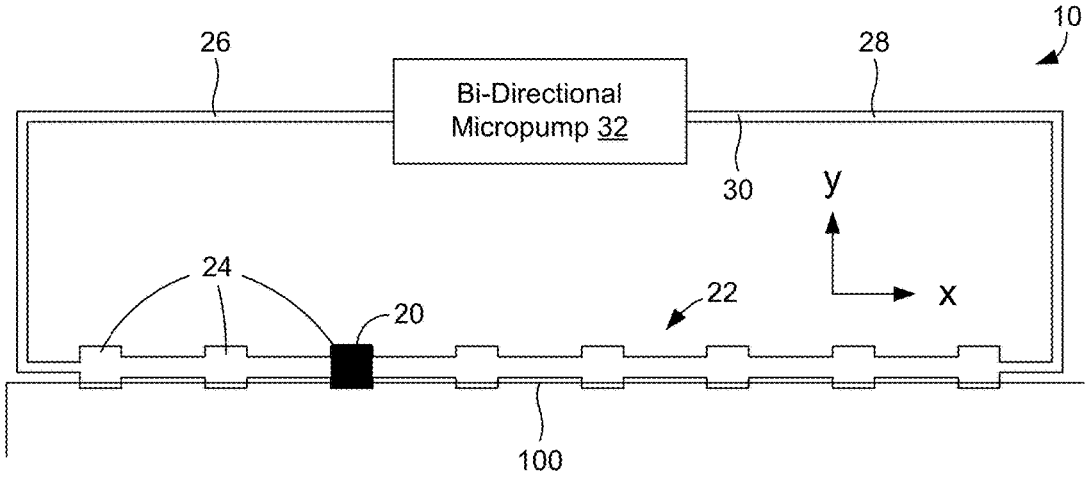
FIG. 9 is a schematic view of an alternative embodiment of a microfluidic focal plane array that can be used to construct the beam scanning antenna of FIG. 1A.

In the above disclosure, the feed networks have been described and illustrated as comprising a resonant corporate feed network comprising a feed line and multiple feed stubs that extend from the feed line to chambers of the microfluidic channel. In some cases, the array pattern of a resonant corporate network fed microfluidic focal plane array can exhibit high side lobe level (SLL) due to the radiation leakage of the unloaded stubs. The SLL can be reduced by employing a feed network that exhibits a fewer number of open stub resonators. This can be accomplished by using a resonant straight feed network comprising a compact straight microstrip line that extends along the channel and terminates with an open circuit. Such an embodiment and its microstrip line 100 are schematically illustrated in FIG. 9. In this configuration, the antenna is loaded with a single straight open stub resonator regardless of its location. Therefore, the microfluidic focal plane array will radiate with a relatively lower SLL as compared to the corporate network fed case.

Figure 10:
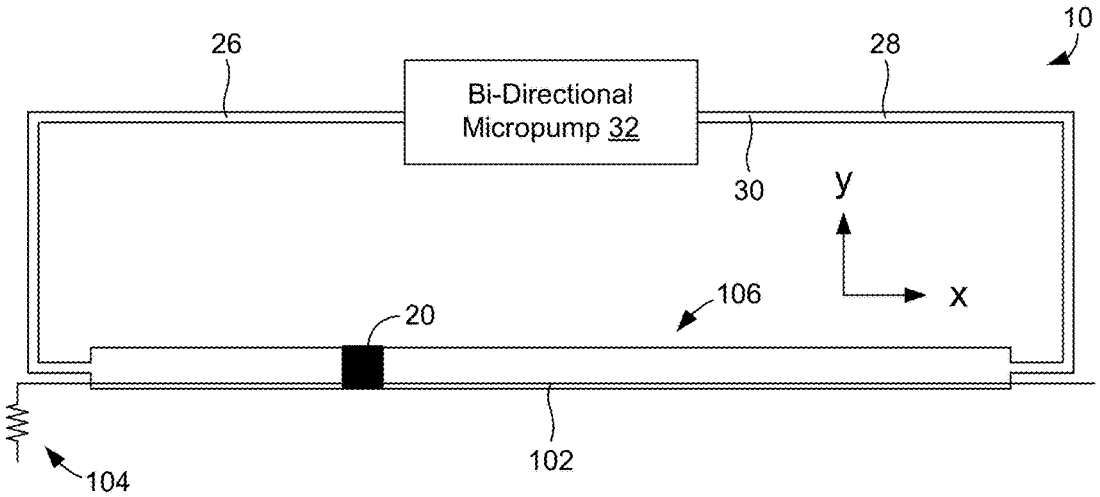
FIG. 10 is a schematic view of another alternative embodiment of a microfluidic focal plane array that can be used to construct the beam scanning antenna of FIG. 1A.

Although resonant straight feed networks improve the SLL, they still exhibit limited bandwidth, which may only be suitable for narrowband applications. For wideband operations, the bandwidth of the feed network can be significantly improved by resorting to a non-resonant layout. In such a layout, the feed network comprises a long straight microstrip line proximately coupled to a microfluidically repositionable patch antenna. Unlike the resonant feed network, the line is terminated with the characteristic impedance of the line, $Z_0$. This can be achieved using a resistor placed at the open end of the line. Therefore, the feed network is non-resonant without bandwidth limitation at the expense of being lossy. In this layout, the antenna element can be positioned at any arbitrary location (not only discrete chambers) without losing its impedance matching. Hence, the feed network allows for continuous beam scanning. FIG. 10 schematically illustrates such an embodiment. The embodiment includes a microstrip line 102 connected to a resistor 104 and a continuous microfluidic channel 106 that comprises no discrete chambers.

The invention claimed is:

1. A microfluidic beam scanning focal plane array for a beam scanning antenna, the microfluidic focal plane array comprising:

an elongated, straight microfluidic channel that contains an electrically conductive antenna element suspended within a dielectric fluid that is provided within the channel, the channel including multiple microfluidic chambers that are positioned at discrete locations along the length of the microfluidic channel and adapted to alternately receive the antenna element such that the antenna element can be selectively positioned at different locations along the length of the microfluidic channel; and means for moving the position of the antenna element along a length of the channel to change a direction along which electromagnetic waves are transmitted or received.

2. The microfluidic focal plane array of claim 1, wherein the array is a one-dimensional array that includes only the elongated microfluidic channel.

3. The microfluidic focal plane array of claim 1, wherein the array is a two-dimensional array that includes multiple microfluidic channels in fluid communication with each other that are arranged in rows and columns in a two-dimensional array.

4. The microfluidic focal plane array of claim 1, wherein the array is planar.

5. The microfluidic focal plane array of claim 1, wherein the array is curved.

6. The microfluidic focal plane array of claim 1, wherein the means for moving comprise one or more fluid pumps.

7. The microfluidic focal plane array of claim 1, further comprising a feed network having a feed stub associated with each of the chambers.

8. The microfluidic focal plane array of claim 7, wherein the feed stubs do not contact the antenna element or the dielectric fluid but are adapted to proximity feed a chamber when the antenna element is present within the chamber.

9. The microfluidic focal plane array of claim 1, wherein the antenna element comprises a volume of conductive fluid.

10. The microfluidic focal plane array of claim 9, wherein the conductive fluid is a liquid metal.

11. The microfluidic focal plane array of claim 1, wherein the antenna element comprises a metal plate or bead.

12. The microfluidic focal plane array of claim 10, wherein the antenna element is a metallized plate or bead.

13. The microfluidic focal plane array of claim 1, wherein the array is constructed from a stack of layers of material.

14. The microfluidic focal plane array of claim 13, wherein the layers of material are flexible such that the array can conform to a curved surface.

15. The microfluidic focal plane array of claim 1, wherein the dielectric fluid comprises polytetrafluoroethylene fluid.

16. The microfluidic focal plane array of claim 6, wherein the pumps include a bi-directional micropump.

17. The microfluidic focal plane array of claim 7, wherein the feedstubs have lengths that are one half of a wavelength of a frequency at which the beam scanning antenna operates.

18. The microfluidic focal plane array of claim 7, wherein the microfluidic chambers and feedstubs are spaced one wavelength of the frequency at which the beam scanning antenna operates.

* * * * *